US005196768A

United States Patent [19]

Sluyterman

[11] Patent Number: 5,196,768

[45] Date of Patent: Mar. 23, 1993

[54] COLOR DISPLAY TUBE SYSTEM

[75] Inventor: Albertus A. S. Sluyterman, Eindhoven, Netherlands

[73] Assignee: U.S. Philips Corporation, New York, N.Y.

[21] Appl. No.: 859,198

[22] Filed: Mar. 27, 1992

[30] Foreign Application Priority Data

Apr. 4, 1991 [EP] European Pat. Off. ..... 91200783

[51] Int. Cl.[5] ..... G09G 1/28; H01F 7/00; H01J 29/50

[52] U.S. Cl. ..... 315/368.28; 335/210; 313/412

[58] Field of Search ..... 315/368.25, 368.15, 315/368.28; 335/260; 313/412

[56] References Cited

U.S. PATENT DOCUMENTS 3,725,831 4/1973 Barbin ..... 335/210

5,027,042 6/1991 Sluyterman et al. ..... 315/368

FOREIGN PATENT DOCUMENTS 0382299 2/1990 European Pat. Off. .

0421523 9/1990 European Pat. Off. .

61-208725 9/1986 Japan .

2223124 3/1990 United Kingdom .

*Primary Examiner*—Gregory C. Issing

*Attorney, Agent, or Firm*—Robert J. Kraus

[57] ABSTRACT

Color display tube comprising an electron gun for producing three co-planar electron beams, and including a deflection system which, in operation, generates deflection fields of the self-convergent type, with three consecutive elements influencing convergence being arranged between the electron gun and the display screen, the two outer elements producing, in operation, opposite effects and the central element being energizable for correcting remaining convergence errors.

5 Claims, 5 Drawing Sheets

COLOR DISPLAY TUBE SYSTEM

BACKGROUND OF THE INVENTION

The invention relates to a colour display tube system comprising a) an evacuated envelope having a neck, a cone and a display window, b) an electron gun in the neck, which gun has a beam-forming part for generating a central electron beam and two outer electron beams whole axes are co-planar, and a first and a second electrode system which in operation jointly constitute a main lens and are connectable to means for supplying an energizing voltage, and c) a deflection unit for generating deflection fields for deflecting the electron beams in the horizontal and vertical directions and for scanning the display window by means of convergent beams.

Colour display tube systems of the type described in the opening paragraph are of the conventional 3-in-line type. They generally comprise self-convergent deflection units which in operation generate non-uniform magnetic fields for horizontal and vertical deflection (particularly a barrel-shaped field for the vertical deflection and a pincushion-shaped field for the horizontal deflection) so that the three electron beams generated by the electron gun and focused on the display screen by the main lens converge throughout the display window.

However, these self-convergent fields cause the horizontal spot growth to increase by a given factor in the case of deflection, which factor may be more than two in 110° colour display tube systems. This notably means that in a normal self-convergent system, in which the three guns are located in a horizontal plane, the circular central spot becomes flat in the vertical direction and very elongate in the horizontal direction, particularly when using a gun having a dynamic astigmatic focusing facility and when scanning the screen. As a result loss of resolution occurs in the horizontal direction and there is a risk of Moire problems owing to the spot becoming flatter and the existence of horizontal dams in the shadow mask. The increasingly stricter requirements imposed on the homogeneity and the definition of the image, notably in high-resolution colour monitor tubes or when using colour display tubes for high-definition television with a display screen having a 9:16 aspect ratio imply that the spot throughout the screen should be as small and as uniform as possible.

SUMMARY OF THE INVENTION

It is one of the objects of the invention to provide a colour display tube of the type described in the opening paragraph in which the above-mentioned requirements are met to better advantage.

To achieve this object, a colour display tube according to the invention is characterized in that three consecutive elements influencing convergence are arranged around the envelope between the beam-forming part of the electron gun and the side of the deflection unit facing the display window, the two outer elements producing, in operation, opposite effects and the central element being energizable for correcting remaining convergence errors. A special embodiment is characterized in that the first outer element generates, in operation, a magnetic field which exerts a force on each outer electron beam having a component in the plane of the electron beam directed towards the central electron beam and in that the other outer element generates, in operation, a magnetic field which exerts a force on each outer electron beam having a component in the plane of the electron beams directed away from the central electron beam.

The invention is based on the following recognition. Due to the two elements exerting opposite effects on the convergence, the outer electron beams are, in operation, subjected to a force which, for example, initially drives these electron beams apart (underconvergence) and then bends them towards each other (overconvergence). The two effects introduced by the invention, in the case of deflection, on the convergence of the electron beams substantially compensate each other. The object of the invention is achieved in that in this case the apex angle of each outer electron beam is separately enlarged in the horizontal direction (i.e. in a direction parallel to the plane of the non-deflected beams), which results in a reduction of the spot in the horizontal direction. The apex angle is understood to mean the angle between the outer electron paths of one beam. The extent of underconvergence and overconvergence caused by the two outer elements influencing convergence can be adjusted in such a way that a desired reduced spot dimension is realised in the horizontal direction at the ends of the horizontal display screen axis.

The magnetic fields to be generated for the desired effects on convergence may comprise local dipole fields at the location of each of the two outer beams.

For an improved focusing possibility of the electron beams a preferred embodiment of the invention is, however, characterized in that each element influencing convergence is constituted by a configuration of electric coils which are arranged and connected in an electric circuit for generating, in operation a 45° magnetic 4-pole field. If the currents through the quadrupoles are exactly opposite to each other, the two quadrupoles will not compensate each other exactly. For small currents the compensation can be perfected, but due to higher order lens actions there will still be a difference in the case of larger currents. This difference does not result from imperfections of the quadrupoles used. In the first instance it may be attempted to give the current through the two quadrupoles a mutual deviation. However, as large effects are concerned, it is difficult to use different currents without introducing tolerance errors among the quadrupole currents.

The object of the invention is to provide a third quadrupole between the two quadrupoles. With this quadrupole, which does not receive flux from the other quadrupoles as long as it is in the axially correct position, the difference in operation between the two outer quadrupoles can be corrected. Consequently, the main current for energization can flow through the outer quadrupoles. As far as tolerances are concerned, this current is not very critical because the quadrupoles substantially compensate each other qua convergence. The interpositioned quadrupole only needs to perform a small correction, which makes also this quadrupole little critical for deviations.

This provides the possibility of connecting the outer elements influencing convergence in series, which is an important advantage.

The magnetic fields in question may be substantially constant in time. In this case they may be generated, for example, by means of an arrangement of permanent magnets or by means of a configuration of electric coils which are energized with a (substantially constant) direct current. This may make the system relatively simple. If at least the screen-sided element influencing convergence is implemented as a permanent magnetic arrangement (for example, as a ring having four magnetic poles induced therein), there is another advantage. Such an arrangement may be placed, for example, within the deflection unit, i.e. at a large distance from the gun. The amount of dynamic focusing voltage required in DAF guns then appears to be reduced. This is particularly important for guns having an "elongate" focusing lens such as focusing lenses constituted by a helical high-ohmic resistance structure, because these lenses require a larger amount of focusing voltage.

To ensure that the spot dimension in the centre of the display screen does not become too large in the y direction, configurations of electric coils can be generated with a DC signal whose value does not only depend on the amplitude of the line deflection signal. In this case a relatively simple circuit arrangement is sufficient. An even better result can be obtained by dynamically controlling the configurations of coils generating the 4-pole fields such that the vertical dimension of the spot in the centre has a desired small value. To achieve this, the means for producing the 45° 4-pole fields may be fed, in operation, for example with currents which are approximately proportional to the square value of the line deflection current (i.e. the means for generating the 45° 4-pole fields can be energized by means of a line-parabolic voltage). This can be realised by means of a circuit which is not too complicated, as will be further described.

If the magnetic fields used for influencing convergence are generated by means of configurations of electric coils, each coil may be wound on an annular core coaxially surrounding the neck of the tube. This requires a relatively long tube neck. The tube neck may be shorter if the screen-sided configuration of electric coils is arranged on the annular core of the deflection Some embodiments of the invention will now be described in greater detail by way of example with reference to the accompanying drawings in which

BRIEF DESCRIPTION OF THE DRAWINGS

Where applicable, identical reference numerals are used for identical components.

DESCRIPTION OF THE PREFERRED EMBODIMENTS

Figure 1A:
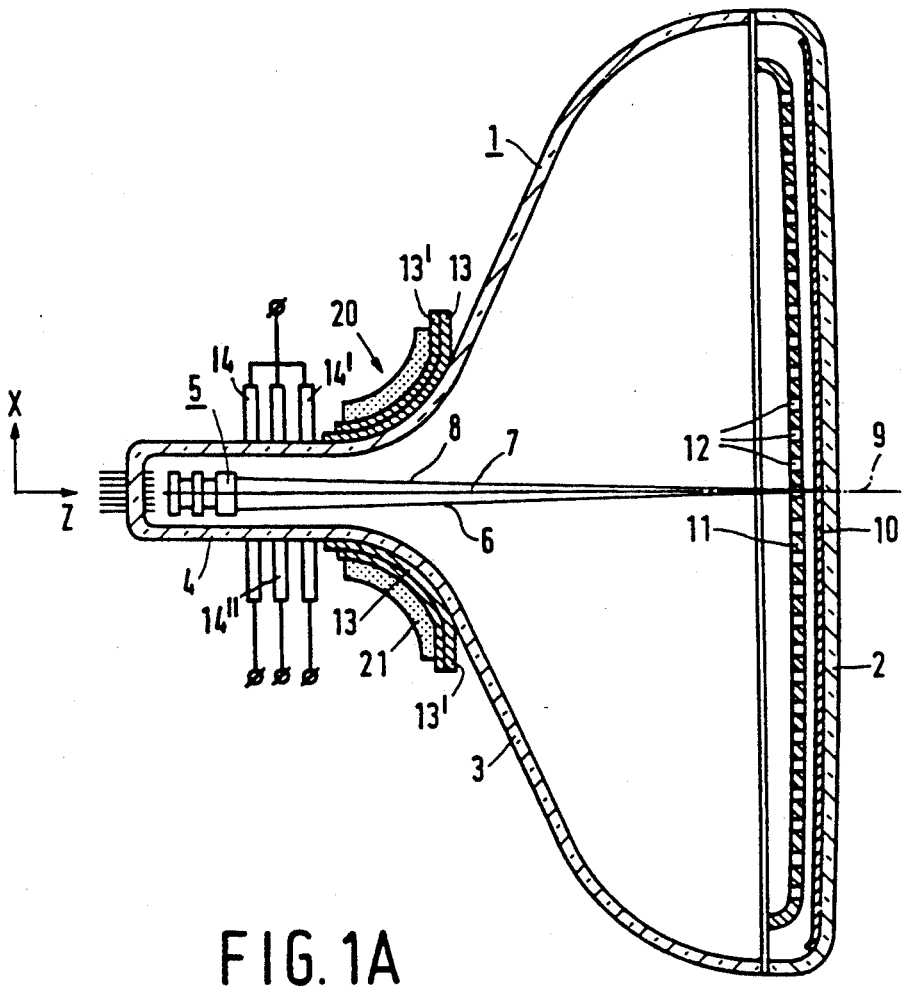
FIG. 1A is a longitudinal section of a colour display tube system according to the invention, including a system with three elements 14, 14', 14'' influencing convergence.
Figure 1B:
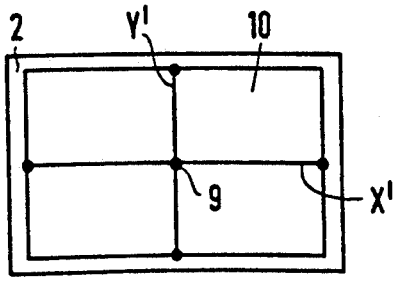
FIG. 1B is an elevational view of a display screen.

FIG. 1 is a cross-section of a colour display tube system according to the invention. A glass envelope 1, which is composed of a display window 2, a cone 3 and a neck 4, accommodates an electron gun 5 which generates three electron beams 6, 7 and 8 whose axes are located in the plane of the drawing. In the non-deflected state, the axis of the central electron beam 7 coincides with the tube axis 9. The display window 2 has a large number of triplets of phosphor elements on its inner side. The elements may consist of, for example, rows or dots. Each triplet comprises a green-luminescing phosphor, a blue-luminescing phosphor and a red-luminescing phosphor. A shadow mask 11 is arranged in front of the display screen, which mask has a large number of apertures 12 through which the electron beams 6, 7 and 8 pass and each impinge upon phosphor elements of one colour only. The three co-planar electron beams are deflected by a deflection unit 20 comprising a system 13 of line deflection coils and a system 13' of two diametrical field deflection coils, as well as an annular core 21 coaxially surrounding at least the system 13 of line deflection coils.

An embodiment of the invention is characterized by means 14 for generating a (gun-sided) magnetic field configuration which, in operation, drives the electron beams 6 and 8 apart in the plane of the electron beams, by means 14' for generating a (screen-sided) magnetic field configuration which drives the electron beams 6 and 8 towards each other in the plane of the electron beams, all this in such a manner that the spot is small enough in the horizontal direction at the ends of the horizontal display screen axis X' (see FIG. 1B), in combination with an interpositioned means 14'' for correcting remaining convergence errors.

The magnetic field configurations to be used may comprise a 45° 4-pole field each. These 4-pole fields may be generated, for example, by means of systems of permanent magnets. Alternatively, they may be generated by means of elements 14, 14' and 14'' (see FIGS. 2A, 2B and 2C) which comprise suitable configurations of electric coils.

Figure 2A:
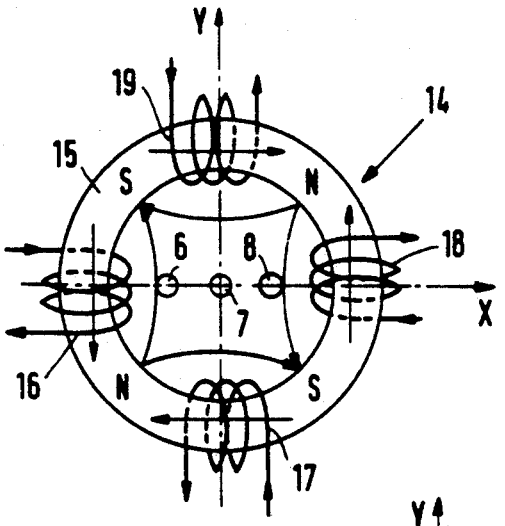
FIGS. 2A, 2B and 2C are elevational views of elements 14, 14', 14'' influencing convergence and implemented as 45° 4-pole elements.
Figure 2B:
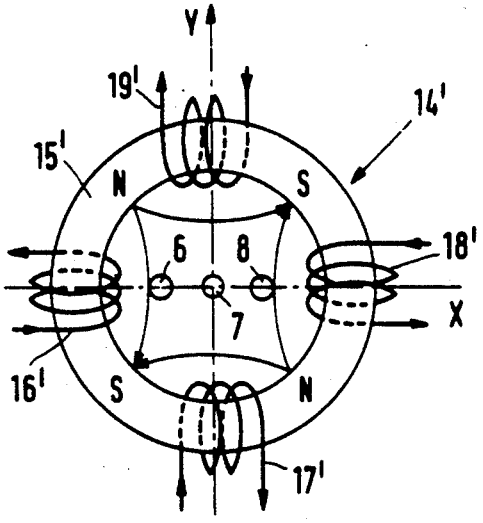
Figure 2C:
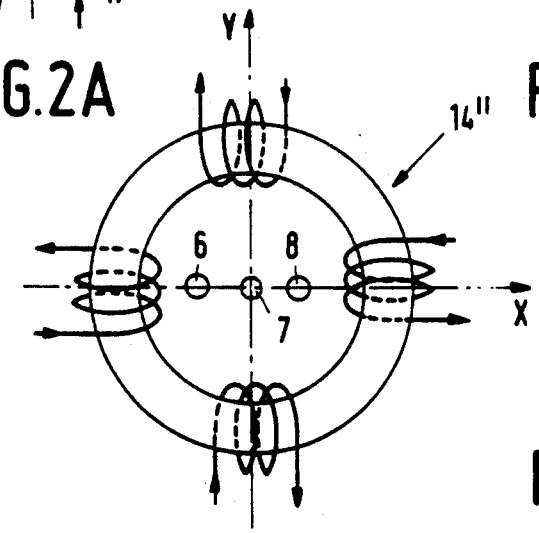
Figure 6:
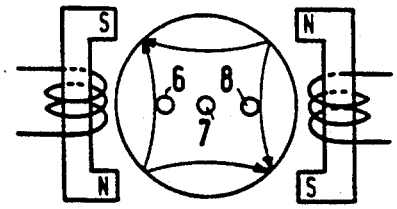
FIGS. 6 and 7 are elevational views of alternative embodiments of 45° magnetic 4-pole elements.
Figure 7:
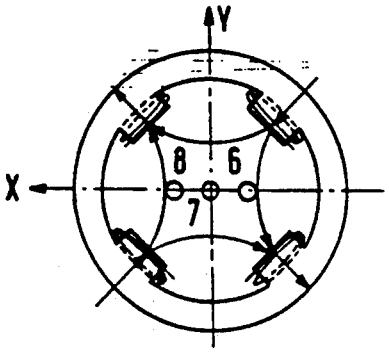

FIG. 2A shows an element 14 influencing convergence which comprises an annular core 15 of a magnetizable material which coaxially surrounds the tube neck (4) and on which four coils 16, 17, 18 and 19 are wound in such a way that a 45° 4-pole field having the orientation shown with respect to the three beams 6, 7 and 8 is generated upon energization. (A 45° 4-pole field may be generated in an alternative way be means of two wound C cores, as shown in FIG. 6, or by means of a stator construction, as shown in FIG. 7). Element 14' (FIG. 2B) has a construction with an annular core 15' and coils 16', 17', 18' and 19', comparable with the construction of element 14. The coils are, however, wound in such a way and the direction in which, in operation, a current flows through the coils is such that a 45° 4-pole field is generated with an orientation which is opposed to that of the 45° 4-pole field in FIG. 2A. FIG. 2C shows correction element 14''. The direction of the current through the coils depends on the required correction in this case.

Figure 8:
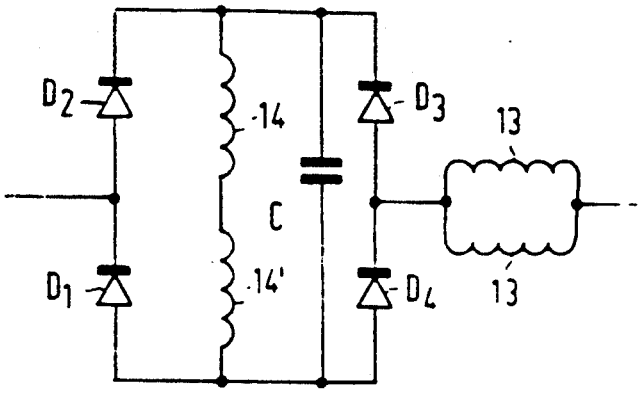
FIG. 8 shows an example of an alternative circuit for connecting the elements 14 and 14' influencing convergence.

For energizing the coil configurations it is possible to use, for example, constant direct currents, or direct currents whose amplitude is coupled to the amplitude of the line deflection signal. A circuit for realising the last-mentioned possibility is shown in FIG. 8 in which the line deflection coils 13, the coils 14, the coils of element 14', four diodes $D_1$, $D_2$, $D_3$ and $D_4$ and a capacitor C are shown diagrammatically. Element 14" is separately controlled in this case. The use of the colour display tube system according to the invention is particularly suitable in high-resolution monitors and in (future) HDTV apparatuses, particularly in those cases where the aspect ratio of the display screen is larger than 4:3, notably 16:9.

Figure 3:
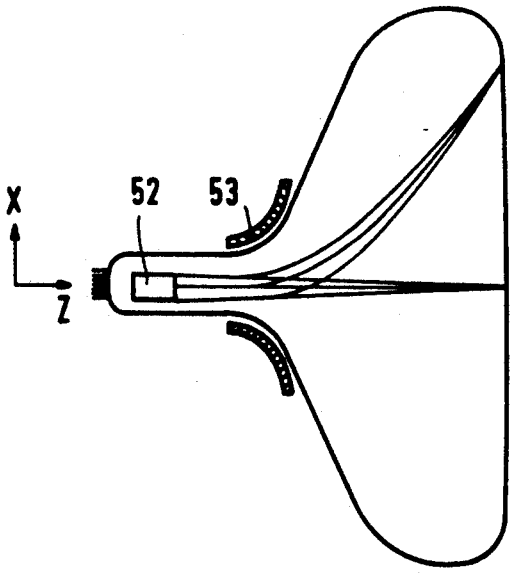
FIGS. 3 and 4A and 4B are diagrammatic cross-sections of colour display tube systems illustrating some aspects of the invention with reference to beam paths.
Figure 4A:
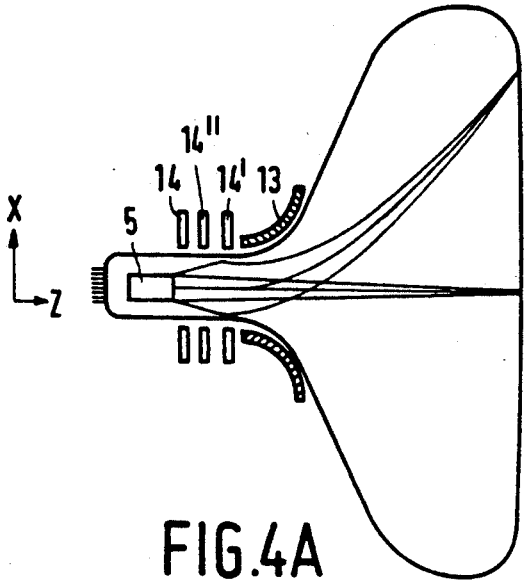
Figure 4B:
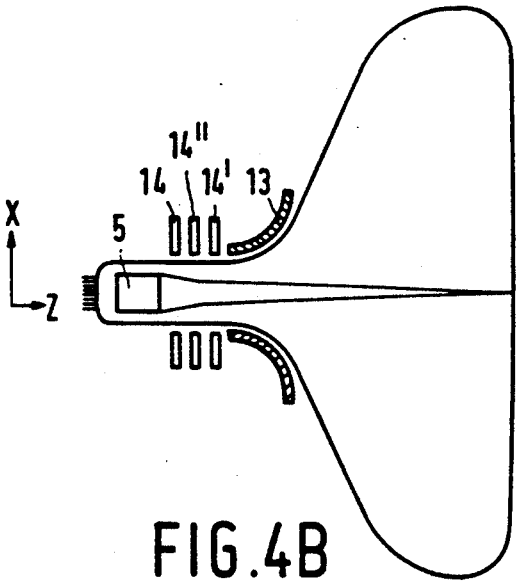

The recognition on which the invention is based will be further described with reference to FIGS. 3 and 4A and 4B diagrammatically showing the beam paths in colour display tubes. FIG. 3 shows a state-of-the-art colour display tube with an electron gun 52 and a self-convergent system 53 of deflection coils. The electron beams converge throughout the display window.

FIG. 4A shows the principle of a colour display tube system according to the invention with a system 13 of line deflection coils. The underconvergence induced by an element 14 influencing convergence and moving the outer beams away from each other, and the overconvergence induced by a subsequent element 14' influencing convergence compensate each other so that the self-convergence is maintained. FIG. 4B shows the situation where the elements 14 and 14' are controlled contrary to the situation of FIG. 4A. In both cases it can be achieved that the spot shape is more homogeneous (more circular) than it was. A more homogeneous spot shape is desired particularly for data displays.

Figure 5:
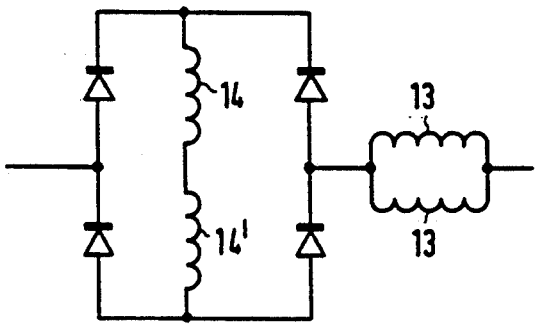
FIG. 5 shows an example of connecting the elements 14 and 14' in an electric circuit.

In order that the vertical dimension of the spot in the centre is sufficiently small, the means for producing the 45° 4-pole fields may be fed, in operation, with currents which are a substantially quadratic function of the line deflection current (i.e. the means for generating the 45° 4-pole fields can be energized by means of a line-parabolic voltage). This can be realised by means of the circuit shown in FIG. 5, as will be further described. The currents should be applied in such a way that the outer 4-pole fields have an opposed orientation. The function which the above-mentioned line parabola represents may have its minimum value on the zero line.

In those cases where the spot dimension in the x direction at the ends of the horizontal axis is sufficiently small, but not in the y direction, the dimension in the y direction can be realised satisfactorily by putting the minimum value of the above-mentioned function below the zero line.

It can be ensured with the aid of the afore-described means that the spot is very small in a colour display tube using self-convergent deflection fields. For high-resolution applications the spot should not only be small but should also remain in focus as much as possible when it is deflected across the screen. To realise this, the means according to the invention can be combined with an electron gun having a static, or particularly dynamic astigmatic focusing facility. An example of such a gun is the DAF gun.

Figure 9:
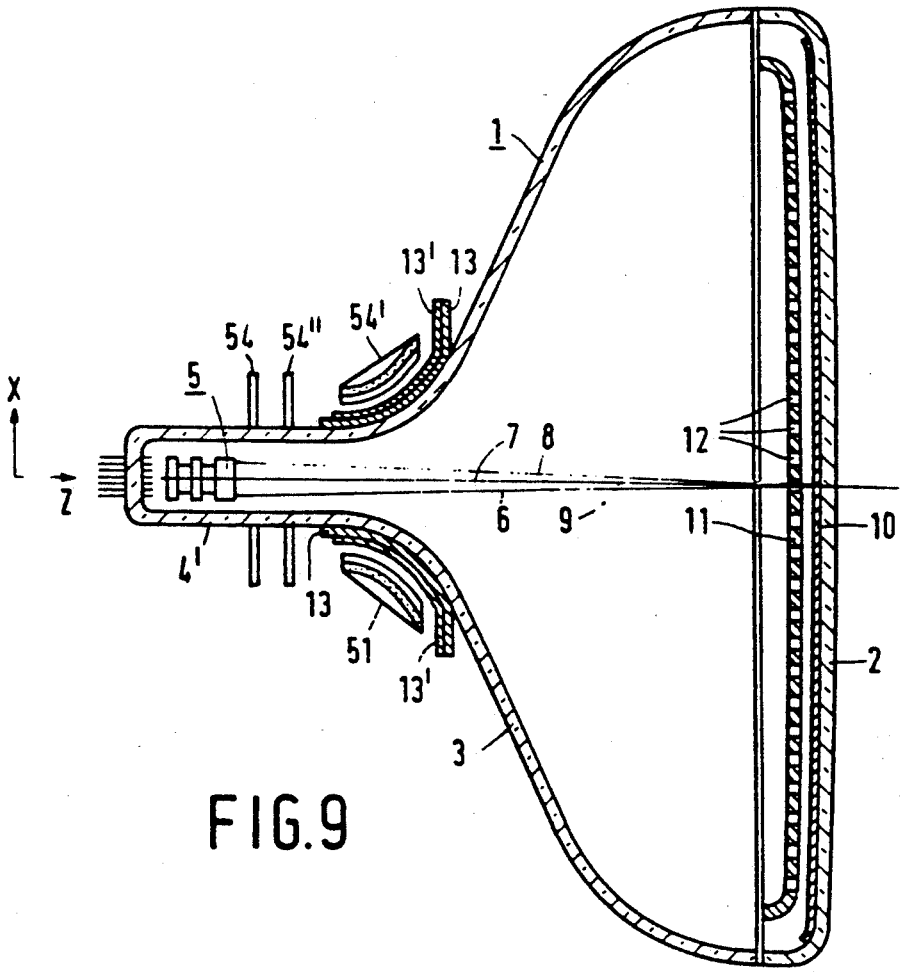
FIG. 9 is a longitudinal section of a colour display tube system including elements 54,54' and 54'' influencing convergence.
Figure 10A:
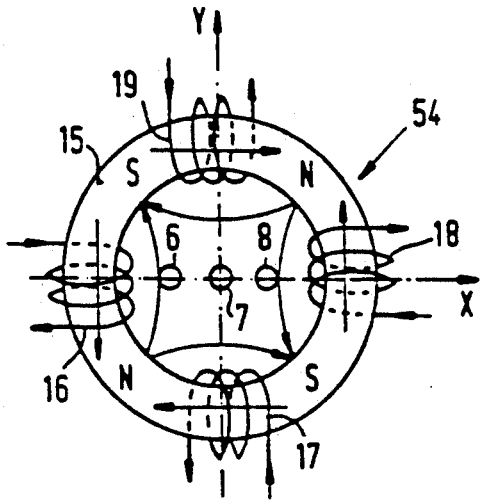
FIGS. 10A and 10C are front elevations of the elements 54 and 54''.
Figure 10B:
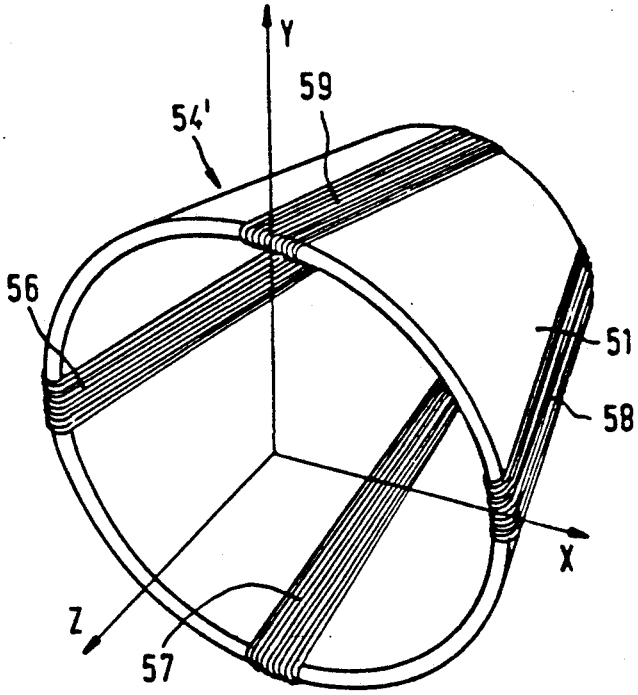
FIG. 10B is a perspective elevational view of the element 54'.
Figure 10C:
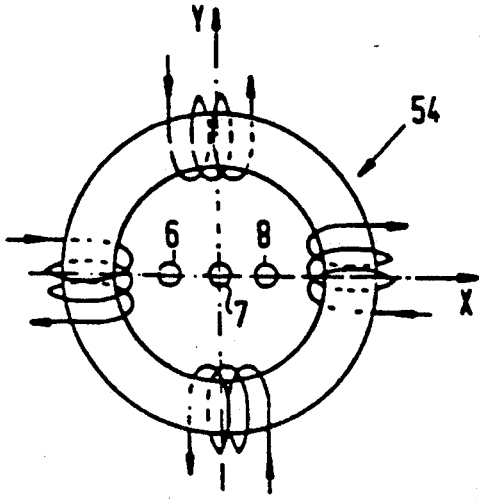

FIG. 9 shows an alternative embodiment of a colour display tube system according to the invention. In this embodiment the tube has a gun-sided element 54 influencing convergence for driving apart the outer electron beams of the type having its own annular core which is shown in FIG. 12A. In this embodiment the screen-sided element 54' influencing convergence for driving the outer beams towards each other comprises a coil configuration which is arranged on the annular core 51 of the deflection unit. FIG. 12B shows the annular core 51 of the deflection unit with coil configurations 56, 57, 58 and 59, which is connectable to a voltage source in such a way that a 4-pole field having an orientation for driving the outer beams towards each other is generated. In this case the neck 4' of the colour display tube system 1' may be shorter than the neck 4 of the system in FIG. 1A. FIG. 10C is a front elevation of correction element 54" of FIG. 9.

I claim:

1. A colour display tube system comprising a) an evacuated envelope having a neck, a cone and a display window, b) an electron gun in the neck, which gun has a beam-forming part for generating a central electron beam and two outer electron beams whose axes are coplanar, and a first and a second electrode system which in operation jointly constitute a main lens, and c) a deflection unit for generating deflection fields for deflecting the electron beams in the horizontal and vertical directions and for scanning the display window by means of convergent beams, characterized in that three consecutive elements influencing convergence are arranged between the beam-forming part of the electron gun and the side of the deflection unit facing the display window, the two outer elements producing, in operation, opposite effects and the central element being energizable for correcting remaining convergence errors.

2. A colour display tube system as claimed in claim 1, characterized in that the first outer element generates, in operation, a magnetic field which exerts a force on each outer electron beam having a component in the plane of the electron beams directed towards the central electron beam and in that the other outer element generates, in operation, a magnetic field which exerts a force on each outer electron beam having a component in the plane of the electron beams directed away from the central electron beam.

3. A colour display tube system as claimed in claim 1 or 2, characterized in that each element influencing convergence is constituted by a configuration of electric coils which are arranged and connected in an electric circuit for generating, in operation, a 45° magnetic 4-pole field.

4. A colour display tube system as claimed in claim 3, characterized in that the outer elements are electrically connected in series.

5. A colour display tube system as claimed in claim 2, characterized in that, in operation, the magnetic fields are substantially constant in time.

* * * * *